US007556658B2

(12) United States Patent
Koh et al.

(10) Patent No.: US 7,556,658 B2
(45) Date of Patent: Jul. 7, 2009

(54) FUEL COMPOSITION AND A DEVICE FOR COLORED FLAMES

(75) Inventors: Sun-Ho Koh, Seoul (KR); Jin-Man Im, Seoul (KR)

(73) Assignee: Hwalim Technological Co., Ltd., Seoul (KR)

( * ) Notice: Subject to any disclaimer, the term of this patent is extended or adjusted under 35 U.S.C. 154(b) by 630 days.

(21) Appl. No.: 10/525,599

(22) PCT Filed: Aug. 22, 2003

(86) PCT No.: PCT/KR03/01692

§ 371 (c)(1),
(2), (4) Date: Oct. 7, 2005

(87) PCT Pub. No.: WO2004/018593

PCT Pub. Date: Mar. 4, 2004

(65) Prior Publication Data

US 2006/0096164 A1 May 11, 2006

(30) Foreign Application Priority Data

Aug. 22, 2002 (KR) ..... 10-2002-0049837

(51) Int. Cl.
*C10L 1/182* (2006.01)

(52) U.S. Cl. ..... 44/388; 44/412; 44/438; 44/451; 44/452; 44/642

(58) Field of Classification Search ..... 431/191, 431/302, 326, 310; 44/600, 388, 451, 452, 44/438, 437, 439, 642
See application file for complete search history.

(56) References Cited

U.S. PATENT DOCUMENTS

| | | | | |
|---|---|---|---|---|
| 4,997,457 | A | 3/1991 | Mitsusawa et al. | |
| 6,419,713 | B1 | 7/2002 | Durand et al. | |
| 2003/0211434 | A1 * | 11/2003 | Matsuyama | 431/11 |

FOREIGN PATENT DOCUMENTS

| | | | |
|---|---|---|---|
| EP | 1323812 | A2 * | 7/2003 |
| JP | 04-065489 | A | 3/1992 |

(Continued)

OTHER PUBLICATIONS

PCT International Search Report, PCT/KR03/01692, Oct. 30, 2003, 2 pages.

*Primary Examiner*—Ellen M McAvoy
*Assistant Examiner*—Latosha Hines
(74) *Attorney, Agent, or Firm*—Blakely, Sokoloff, Taylor & Zafman LLP

(57) ABSTRACT

The present invention is related to a fuel composition for colored flames and an appropriate combustion device for using such composition which provides a fuel composition for colored flames with improved inflammability, realization of colored flames and persistency by having alcohol of low ignition point as a fuel, by adding a compound having an ester structure and by adding a fire power enhancer including at least 3 higher hydrocarbon. Also, the present invention provides a combustion device wherein the fuel composition is injected in fog so as to enhance ignition power when rendering colored flames by injecting through an injection nozzle and igniting, the size of flames can be controlled by adjusting pressure, and color of the flames injected through each injection nozzle portion can be realized in different colors respectively by a control device.

6 Claims, 1 Drawing Sheet

FOREIGN PATENT DOCUMENTS

| | | | |
|---|---|---|---|
| JP | 04-117493 | A | 4/1992 |
| JP | 05-059377 | A | 3/1993 |
| KR | 2000-73621 | A | 12/2000 |
| KR | 2003-54768 | A | 7/2003 |

* cited by examiner

FUEL COMPOSITION AND A DEVICE FOR COLORED FLAMES

CROSS-REFERENCE TO OTHER APPLICATIONS

This is a National Phase of International Application No. PCT/KR2003/001692, filed on Aug. 22, 2003, which claims priority from Korean Patent Application No. 10-2002-0049837, filed on Aug. 22, 2002.

TECHNICAL FIELD

The present invention relates to a fuel composition for colored flames. More particularly, it relates to a fuel composition which presenting colored flames to be used for various festivities.

Also, the present invention relates to a burning device appropriate for using said fuel composition. More particularly, it relates to a device, which projects the said fuel composition into the air and ignites it to show various and specific colored flames. This device is designed to be appropriate for the complete oxidation of the said fuel composition, which is essential for manifesting colored flames, and the selection of flame colors, size of flames, and the duration time of each flame can be controlled by exterior pre-determined data.

BACKGROUND ART

In prior art, burning oil for lamps presenting colored flames to be used for interior decoration or for festivals has already been published (Korean Patent Application No. 2001-85176). However, due to its low flammability and limited size of the flame, it was mainly intended for using as an interior decoration and was not appropriate for the sacred torch of the Olympic games or other sports events, or for festivals, concerts, and outdoor parties, where the flames require higher flammability and longer flame size.

Also, the flame which had been previously used for interior decoration or for festivals maintained only a single color during the whole event or festival, and thus it was less effective in arousing magnificence and mystical feelings, and attracting public attention continuously.

Furthermore, fuels such as LPG or LNG and petroleum which are conventionally used to present flames for outdoor festivals, do have such a disadvantage that the fuels are generating too much smoke or soot while burning, and they also are not economically efficient because they require considerably large amount of coloring agent.

Accordingly, a new burning device which is harmless to human body while burning, with vivid and changeable colored flames with the progress of time, is long waited and demanded by entertainment companies, festivals organizers, and those in the fields of event related industries.

DISCLOSURE OF THE INVENTION

It is an object of the present invention to provide a fuel composition with enhanced colored flame presentation by enhancing its flammability and ignitability so as to enable the fuel to be lighted up the moment the fuel belches up from the device for colored flames like fog.

It is another object of the present invention to provide a fuel composition for colored flame which presents color more easily by providing optimum colored flames without producing any by-product such as soot by minimizing the imperfect lighting of the solution, and which presents a more longlasting and magnificent colored flame by minimizing outdoor environment effect, when using it in a burning device.

It is still another object of the present invention to provide a device whose movement and operation have been facilitated by setting a pattern in the perfect combustion, flame size and color change of the liquid fuel which presents colored flames using said fuel composition with enhanced flammability and ignitability, by controlling perfect combustion, flame size and color change based on predetermined data.

The present inventors completed the fuel composition for colored flames of the present invention with enhanced flammability, ignitability, colored flame presentation and continuity by using an alcohol with a low ignition point as a fuel, and enhancing the dispersion of the coloring agent by adding a compound having an ester structure, and adding a fire power enhancer including more than three higher hydrocarbons.

Further, after going through numbers of tests and adjustments, the present inventors discovered a better fuel composition which minimizes soot, smoke and imperfect lighting by selecting low alcohols such as methanol, and ethanol as a fuel.

Also, the present inventors completed the burning device whose movement and operation have been facilitated by setting a pattern in the perfect combustion, flame size and color change of the liquid fuel which presents colored flames using said fuel composition, by controlling perfect combustion, flame size and color change to serve their purposes based on predetermined data.

The fuel composition for colored flames of the present invention comprises a coloring agent, fuel, an additive having an ester structure and a fire power enhancer including more than three higher hydrocarbons.

More particularly, the fuel composition for colored flames of the present invention comprises 0.1~6% by weight of coloring agent, 75~90% by weight of fuel, 2~20% by weight of additive and 2~10% by weight of fire power enhancer.

The above composition ratio has been completed after going through various tests to find the optimum composition ratio by the inventors.

More particularly, if the coloring agent is less than 0.1% by weight, it cannot present the color of a desired level, and if the coloring agent exceeds 6% by weight, it generates smoke along with a nasty smell, and thus causes safety problems.

If the fuel exceeds 90% by weight, the ignition of the fuel dispersed from the device is inhibited, and if fuel is less than 75% by weight, the colored flames that are presented become low heated.

If the additive is less than 2% by weight, it cannot achieve the desired dispersion of the coloring agent, and if the additive exceeds 20% by weight, there are safety problems.

If the fire power enhancer is less than 2% by weight, it cannot achieve the desired fire power, and if the fire power enhancer exceeds 10% by weight, it reduces the coherence between the solutions and inhibits the presentation of colored flames.

The fuel composition for colored flames of the present invention can obtain enhanced flammability, ignitability and colored flame presentation by being mixed in the above proper composition ratio.

Such composition ratio has been obtained through various tests considering the flammability, ignitability, duration of fire power, color presentation and economical efficiency of the fuel composition, and the composition ratio of the present invention has not been disclosed or suggested in any prior art.

The fuel composition of the present invention is provided in order to present colored flames for outdoor use. That is, it is not appropriate to be used indoors such as in a gymnasium because a nasty smell is generated along with smoke due to the partially imperfect lighting which occurs when it is being lighted up the moment the fuel is being dispersed.

Meanwhile, in accordance with another embodiment of the fuel composition of the present invention, instead of using only one alcohol as the fuel of the fuel composition, a mixed fuel comprising 45~55% by weight of methanol and 25~40% by weight of ethanol is used. This enables to present colored flames indoors as well, while minimizing the smell, soot, smoke and imperfect lighting.

Among said composition ratio, if methanol is less than 45% by weight, the color presentation of the colored flames becomes low heated, and if methanol exceeds 55% by weight, the fuel composition does not get lighted up easily, and thus it is difficult to be used in burning devices.

If ethanol is less than 25% by weight, the ignitability and fire power of the colored flames are reduced, and if ethanol exceeds 40% by weight, it is difficult to present colored flames.

Preferably, 2~10% by weight of propanol may be included in said fuel composition. The addition of propanol of said amount remarkably reduces the smell generated at the time of burning, and thus minimizes the effect of the environment, and increases the continuous burning of the fire power, and ignitability.

Meanwhile, an amine compound may be mixed with said fuel mixture in a desired amount.

A preferable composition ratio of alcohol and amine is as follows.

| Compound | Ratio |
|---|---|
| Amine | 0.1~30% by weight |
| Alcohol | 70~99.9% by weight |

The fuel mixture prepared in the above ratio can maximize the solubility and dispersibility of the coloring agent due to its molecular structure. It also increases its miscibility with the substance prepared according to their use when preparing fuel presenting colors, and activates as a comburent when burning and thus enables fire power and colored flames to be presented easily.

Any substance which maximizes the solubility and color presentation of the coloring agent can be used as a fuel of the fuel composition of the present invention. However, alcohols which have —OH radicals at the end of its molecular structure are used the most.

Preferably, a low alcohol with less than three carbons such as ethanol, methanol or propanol is used alone or in a mixture as desired.

Methanol, ethanol and propanol used in the present invention are preferable in that they have excellent coloring agent solubility and strong coherence with oxygen, and can be easily lighted up by having a low ignition point because they have hydroxide (—OH) group at the end of molecular.

The amines which can be used in the fuel mixture of the present invention can be exemplified as methylamine, ethylamine, propylamine, butylamine, isobutylamine, sec-butylamine, tert-butylamine, cyclohexylamine, benzylamine, p-toluidine, trimethlyamine, triethylamine, tripropylamine, N,N-dimethylaniline, Diethyl aminoethylamine, α-Naphthylamine, 3-Methoxy propylamine, Alkoxy propylamine, Benzylamine, Melamine, Fursultiamine, N-Aminoethyl ethanol amine, N-Pheyl-N'-(1,3-dimethylbuthyl)-p-phenylene diamine, Polyoxyethylene oleylamine.

The coloring agent of the present invention is properly selected according to the color of the desired flame.

The fuel composition of the present invention can provide red, green, orange, yellow, blue, purple, light purple, white rose and rainbow flames depending on the coloring agent.

A detailed description is as follows.

In order to present red flames, it is preferable to use a mixture of lithium chloride and strontium chloride mixed in a proper ratio as a coloring agent. However, depending on its use, lithium salts such as lithium acetate, lithium acetoacetate, lithium acetylacetonate, lithium amide, lithium fluoride, lithium nitrate or lithium sulfate, and strontium salts such as strontium acetate, strontium acetylacetonate, strontium carbonate, strontium nitrate, strontium oxalate or strontium sulfate can be used.

In order to present green flames, it is preferable to use boric acid alone, or to use a mixture of boric acid and copper chloride mixed in a proper ratio as a coloring agent. However, depending on its use, a copper salt selected from a group consisting of copper acetate, copper acetylacetonate, copper cyanide, copper hydroxide, copper sulfate, copper trifluoroacetylacetonate and copper nitrate can be used.

In order to present orange flames, it is preferable to use a mixture of borax and sodium chloride mixed in a proper ratio as a coloring agent. However, depending on its use, any one of sodium acetate, sodium amide, sodium cyanide or sodium nitrate can be used.

In order to present yellow flames, it is preferable to use a mixture of barium chloride and calcium chloride mixed in a proper ratio as a coloring agent. However, depending on its use, any one of barium acetate, barium fluoride, barium nitrate, barium oxalate, barium sulfate, calcium acetate hydrate, calcium fluoride, calcium nitrate, calcium oxalate or calcium sulfate can be used.

In order to present blue flames, it is preferable to use a mixture of copper nitrate and an additive as a coloring agent. However, depending on its use, any one of copper acetate, copper acetylacetonate, copper chloride, copper cyanide, copper hydroxide, copper sulfate or copper trifluoroacetylacetonate can be used.

In order to present purple flames, it is preferable to use a mixture of cerium chloride, potassium formate and a coloring agent presenting red flames (lithium salts and strontium salts) mixed in a proper ratio as a coloring agent. However, depending on its use, any one of cerium acetate hydrate, cerium acetylacetonate hydrate, cerium nitrate, cerium oxalate, cerium sulfate, potassium acetate, potassium acetylacetonate hemihydrate, potassium chloride, potassium chlorate, potassium cyanide, potassium ethoxide, potassium ferricynide, potassium fluoride, potassium oxalate monohydrate, potassium sulfate, potassium sodium tartrate tetrahydrate or potassium nitrate can be used.

In order to present light purple flames, it is preferable to use a mixture of cesium chloride and potassium formate mixed in a proper ratio as a coloring agent. However, depending on its use, any one of cesium acetate, cesium acetylacetonate, cesium fluoride, cesium sulfate, cesium nitrate, cesium oxalate, potassium acetate, potassium acetylacetonate hemihydrate, potassium chloride, potassium chlorate, potassium cyanide, potassium ethoxide, potassium ferricyanide, potassium fluoride, potassium oxalate monohydrate, potassium sulfate, potassium sodium tartrate tetrahydrate or potassium nitrate can be used.

In order to present rainbow flames, a mixture of the coloring agents used to present red, green and blue flames mixed in a proper ratio can be used as a coloring agent.

In order to present white rose flames, a mixture of nitromethane and other coloring agents mixed in a proper ratio can be used as a coloring agent.

Any substance can be used as the additive having an ester structure used in the present invention, if it shows high solubility against the fuel solution and it can easily dissolve the coloring agent.

Preferably, a substance having an ester binding, which enhances flammability and colored flame presentation by inducing equal dispersion of the coloring agent in the solution, wherein the coloring agent, metallic salt is in the form of a solution and a complex salt.

More particularly, methyl acetate, ethyl acetate, butyl acetate, furfuryl acetate, 2,2-dimethylpropanoic acid ethyl ester, 3-furylmethyl acetate, diethoxymethyl acetate, styrallyl acetate, isobutyl acetate, isopropyl acetate, dimethyl ether, ethyl methyl ether, diethyl ether, dipropyl ether, diisopropyl ether, dibutyl ether, 1,2-dimethoxyethane, 1,4-dioxane, acetone, acetonitrile or butyl cellosolve can be used.

It is preferable to use higher hydrocarbon having more than three carbons, alcohols or ketones as the fire power enhancer in the present invention, which enhances flammability and increases duration time. Such fire power enhancer is considered to show an additional effect in increasing the coherence between the fuel solutions.

The fire power enhancer which can be used in the present invention can be exemplified as butyl alcohol, isobutyl alcohol, sec-butyl alcohol, tert-butyl alcohol, pentyl alcohol, hexyl alcohol, heptyl alcohol, octyl alcohol, nonyl alcohol decyl alcohol, allyl alcohol, cyclopentanol, cyclohexanol, benzyl alcohol, hexane, bezene, toluene or acetone.

Among the additives disclosed in the present invention, there are compounds effective in enhancing fire power, and among the fire power enhancers, there are compounds effective in enhancing the dispersion of the coloring agent. Therefore, in the present invention, additives and fire power enhancers cannot be considered completely separated from each other. Rather, they can be used properly mixed with each other according to the required the coloring agent dispersion and fire power.

Further, in accordance with the object of the present invention, other additives such as paraffin or dichlomethane can be properly used.

The fuel composition for colored flames of the present invention can be prepared as the following, but it is not restricted to the following.

Selecting a proper coloring agent for the desired color and adding said coloring agent to the fuel;

enhancing the dispersion of the coloring agent in the fuel by adding an additive to the obtained fuel solution; and stirring the mixture after adding the fire power enhancer selected according to the obtained liquid fuel. The specific embodiment of the fuel composition according to the color targeted by the fuel composition of the present invention is as follows.

Red Flame Fuel Composition

TABLE 1

Constitution of red flame fuel composition

| Composition | Percentage (% by weight) |
|---|---|
| Coloring agent | 0.5~1 |
| Fuel solvent | 70~80 |
| Additive | 10~20 |
| Fire power enhancer | 3~10 |

Green Flame Fuel Composition

TABLE 2

Constitution of green flame fuel composition

| Composition | Percentage (% by weight) |
|---|---|
| Coloring agent | 3~4 |
| Fuel solvent | 70~80 |
| Additive | 10~20 |
| Fire power enhancer | 3~10 |

Blue Flame Fuel Composition

TABLE 3

Constitution of blue flame fuel composition

| Composition | Percentage (% by weight) |
|---|---|
| Coloring agent | 1~2 |
| Fuel solvent | 70~80 |
| Additive | 10~20 |
| Fire power enhancer | 4~9 |

Yellow Flame Fuel Composition

TABLE 4

Constitution of yellow flame fuel composition

| Composition | Percentage (% by weight) |
|---|---|
| Coloring agent | 0.1~0.2 |
| Fuel solvent | 70~80 |
| Additive | 10~20 |
| Fire power enhancer | 3~9 |

Purple Flame Fuel Composition

TABLE 1

Constitutional elements of purple flame fuel composition

| Composition | Percentage (% by weight) |
|---|---|
| Coloring agent | 1~2 |
| Fuel solvent | 70~80 |
| Additive | 10~20 |
| Fire power enhancer | 3~10 |

The use of above materials and the composition percentage can be changed and worked by a person skilled in the art by referring to the specification of the present invention. Thus, selection by the person skilled in the pertinent art and change of numerical values are included in the scope of the present invention.

The device for realizing colored flames by using the fuel composition for colored flames of the present invention comprises a fuel reservoir where a preliminary vent valve, a pressure gauge, a fuel inlet, a (safety) valve and a shut off valve are arranged at the upper side, a drain valve and a manual shut-off valve are arranged at the lower side and a number of fuel tanks according to the number of colors to embody are arranged;

a pressure feeding portion having a main pressure shut-off valve controlled and arranged in line to forcibly feed N2 or air of a delivery gas tank by a regulator to form pressure into the above fuel tank;

a pressure regulating portion having pressure regulating valve controlled and arranged in line between the main pressure shut-off valve and the shut-off valve of a fuel reservoir;

an injection combustion portion having an injection nozzle comprising a number of solenoid valves according to the number of colors to embody and branch connected to the line of the manual shut off valve in said fuel reservoir to control amount of fuel and an ignition plug for flame in one side of the injection nozzle;

a control device electronically connected to control the above main pressure shut off valve, pressure control valve, (safety) valve, preliminary vent, solenoid valve and ignition plug according to data pre-established.

Said fuel reservoir may comprise a plurality of fuel tanks according to the number of colors desired for realization.

Said injection combustion portion is connected and installed in a number identical to the number of fuel tanks of the fuel reservoir, and is controlled with electrical signals of the control device, respectively while comprising a number of solenoid valves corresponding to the number of fuel tanks of the fuel reservoir, which may realize various colors of colored flames.

BEST MODE FOR CARRYING OUT THE INVENTION

Figure 1:
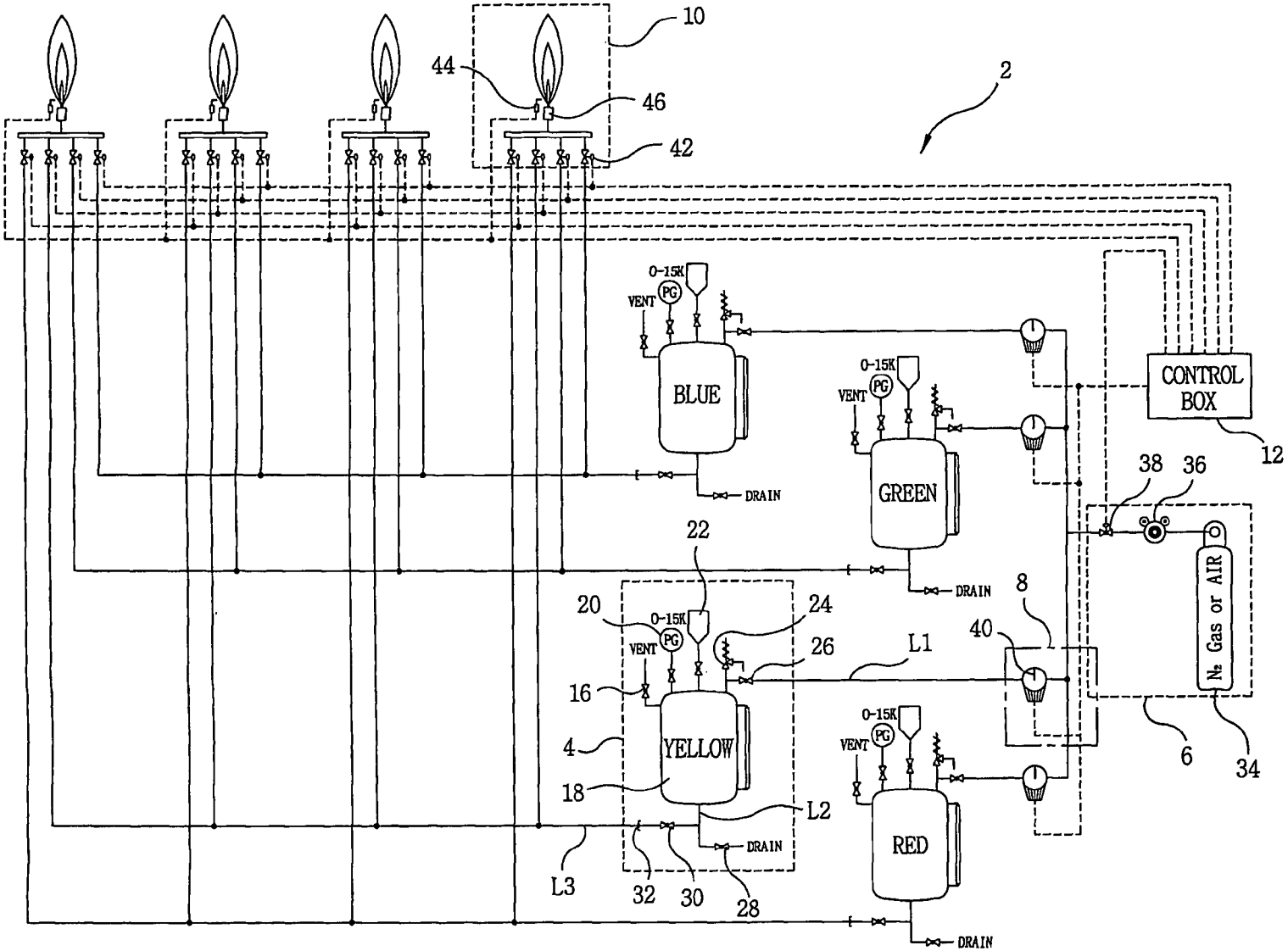
FIG. 1 is a block diagram illustrating a device for realizing colored flames according to the present invention.

Hereinbelow, the present invention is described in details according to the embodiments and the drawings. However, the embodiments do not translate into restricting the scope of the present invention.

EXAMPLE 1

Preparation of Red Flame Fuel Composition I

After adding 1 g of lithium chloride to 79 g of ethanol, the fuel solution including a coloring agent is obtained by stirring up at the room temperature for 20 minutes in 280 rpm and by dissolving.

After adding 13 g of ethyl acetate to the obtained fuel solution, the fuel solution is stirred up for 10 minutes at the room temperature. The desired colorless and transparent red colored flame fuel composition was obtained by adding 3 g of butanol and 4 g of hexane to the obtained fuel solution and by stirring up for 10 minutes at the temperature of 30° C. in synthetic chamber.

The composition ratio of the obtained fuel composition is as follows.

| Composition | Ratio (% by weight) |
|---|---|
| Lithium chloride | 1 |
| Ethanol | 79 |
| Ethyl acetate | 13 |
| Butanol | 3 |
| Hexane | 4 |
| Total amount | 100 |

The fuel composition of the present example has realized a red colored flame for festivals brilliant at combustion, and the amount of black dirt generated at combustion is small.

EXAMPLE 2

Preparation of Red Flame Fuel Composition II

After adding 1 g of lithium chloride to 35 g of ethanol, the fuel solution including a coloring agent is obtained by stirring up at the room temperature for 20 minutes in 280 rpm and by dissolving.

After adding 49 g of methanol and 9 g of acetone to the obtained fuel solution, the fuel solution is stirred up for 10 minutes at the room temperature. The desired red colored flame fuel composition was obtained by adding 6 g of 1-propanol to the obtained fuel solution and by stirring up for 10 minutes at the temperature of 30° C. in synthetic chamber.

The composition ratio of the obtained fuel composition is as follows.

| Composition | Ratio (% by weight) |
|---|---|
| Lithium chloride | 1 |
| Methanol | 49 |
| Ethanol | 35 |
| Acetone | 9 |
| Propanol | 6 |
| Total amount | 100 |

The fuel composition of the present example has realized a red colored flame for festivals brilliant at combustion, and the amount of smoke and black dirt generated at combustion is at the level of capable of being used even in the indoor gymnasium, etc. Also, the production of material generated at incomplete combustion remained at the minimum level.

EXAMPLE 3

Preparation of Can Type Fuel Composition for Red Flame

After adding 1 g of lithium chloride to 10 g of ethanol, the fuel solution including a coloring agent is obtained by stirring up at the room temperature for 20 minutes in 280 rpm and by dissolving.

After adding 69 g of methanol and 18 g of acetone to the obtained fuel solution, the fuel solution is stirred up for 10 minutes at the room temperature. The obtained fuel solution is put into the synthetic chamber of 30° C. and while adding 2 g of paraffin and other additives such as scent and dye, etc., the fuel solution is stirred up for 10 minutes and the desired red colored flame fuel composition was obtained.

The composition ratio of the obtained fuel composition is as follows.

| Composition | Ratio (% by weight) |
|---|---|
| Lithium chloride | 1 |
| Methanol | 69 |
| Ethanol | 10 |
| Acetone | 18 |
| Paraffin | 2 |
| Total amount | 100 |

The fuel composition of the present example has realized a red colored flame for festivals mild at combustion, and the black dirt generated in large amount at combustion and the production of material generated at incomplete combustion remained at the minimum level.

The fuel compositions of examples 1 and 2 are fuels manufactured, in order to be used in the combustion device. However, the fuel composition of example 3 uses wick without requiring a special combustion device in order to increase absorption capability for the wick to be easily usable as fuel used for outdoor festivals, and to realize mild colored flames by minimizing effects rendered to the surrounding environment as fuel with improved fire power while maintaining colored flames continuously.

The above examples 1 to 3 describe only the fuel composition for red flame, but the color of the flame is selected by the coloring agent. Thus, the same applies to the fuel composition of the above listed colors for flames.

The combustion device for realizing colored flames by using fuel composition for colored flames manufactured in the above examples 1 to 3 is described in detail pursuant to the accompanying drawings.

FIG. 1 is a block diagram illustrating the liquid fuel injection device for realizing colored flames according to the present invention.

The combustion device (2) for realizing colored flames mainly comprises a fuel reservoir (4), a pressure feeding portion (6), a pressure regulating portion (8), an injection combustion portion (10), and a control device (12).

The fuel reservoir (4) is installed/arranged with a preliminary vent valve (16) prepared to adjust air pressure at the upper portion, a pressure gauge (20) indicating pressure within the fuel tank (18), a fuel inlet (22) prepared to inject various liquid fuels prepared for realizing various colors, and a (safety) valve (24) to adjust over-pressure within the fuel tank (18).

A shut-off valve (26) manually operated by an operator for air supply (or nitrogen gas) to the fuel tank (18) in line (L1) comprising said (safety) valve (24) is installed in order to prevent generation of over-pressure within the fuel tank (18).

Further, the lower side of the fuel tank (18) is provided with a drain valve (28) installed to discharge for exchanging fuel or cleaning inside the container/vessel, and in line (L2) provided also with the drain valve (28), a manual shut-off valve (30) in order to block the fuel supply when moving or separating the fuel tank (18) is provided. On one side, a line connection joint (32) is provided for easy separation and assembly.

The aforementioned fuel tank (18) may comprise a plurality of numbers of colors starting from one color desired according to the characteristics of the events/functions, which is not limited to the number.

The aforementioned fuel reservoir (4) may be comprised in a plurality of combustion devices (2) according to the number of colors desired.

The pressure feeding portion (6) is provided with a main pressure shut-off valve (38) to control amount of supply by electrical signals when supplied by the regulator (36) with nitrogen or air within the supply gas tank (34) so as to forcibly form nitrogen or air pressure within the fuel tank (18).

The pressure regulating portion (8) is installed with a pressure regulating valve (40) arranged in line (L1) between the main pressure shut-off valve (38) and the shut-off valve (26) of fuel tank (18) in order to control air pressure supplied to the liquid fuel tank (18) of the fuel reservoir (4) with electrical signals.

The injection combustion portion (10) comprises a number of solenoid valves to control and supply with electrical signals fuel of a color to be realized by being connected to the line (L3) of the manual shut off valve (30) in the fuel reservoir (4).

The aforementioned injection combustion portion (10) has an injection nozzle (46) wherein the amount of injection is controlled by each of the electrical signals of the control device (12) and comprises a number of solenoid valves (42) corresponding to the number of the fuel tank (18) of the fuel reservoir (4) in the injection nozzle (46) so as to provide supply of fuel. The solenoid valves (42) are connected to each of the respective fuel tank (18) with line (L3).

The ignition plug (44) is installed at one side of the injection nozzle (46) in the injection combustion portion (10) to generate flames by electrical signals.

Moreover, the control device (12) is electrically connected to each of the main pressure shut off valve (38), the pressure control valve (40), the solenoid valve (42) and the ignition plug (44) so as to be controlled by pre-established information/data.

To explain the working of the present invention constructed as above, the control device (12) opens the main pressure shut-off valve (38) with control signals according to the pre-established information/data to supply air or nitrogen gas within the supply gas tank (34) to the fuel tank (18) by the regulator (35) for forming uniform pressure.

When air or nitrogen gas is supplied to the aforementioned fuel tank, the over-pressure is prevented by the valve (24) while being forcibly supplied through the shut-off valve (26) opened in the line (L1) to form pressure so as to uniformly supply fuel to the injection combustion portion (10).

At this moment, in the line (L1) supplied to the fuel tank (18) through the main pressure shut-off valve (38), the pressure control valve (40) operated by signals from the control device (12) controls the air pressure or the nitrogen gas pressure.

Accordingly, by the pressure formed from the fuel tank (18), the fuel which is full in the line (L3) extended to the injection nozzle (46) controls the opening amount of each of the respective solenoid valves (42) installed at the corresponding plurality of the lines (L3) of the injection nozzles (46) by the pre-established information/data.

Pursuant to the opening amount of each of the solenoid valves (42) of the injection combustion portion (10), the amount of fuel supply is controlled and simultaneously, the colored flames are realized as the ignition of the flame is made simultaneously at the ignition plug (44) with the electrical signals of the control device.

Also, by controlling the extent of the opening of each of the solenoid valves (42) prepared at each injection combustion portion (10) by the control device (12) with the pre-established information/data, the height of the flames and color of the flames can be variously changed.

The present invention injects liquid fuel through the nozzle while appearing in color in order to strengthen the combustion power while controlling the size of the flames through the control of the pressure, and may change the color of the flames by continuously changing the valve device when injecting the fuel to each of the nozzles.

The injection device of the present invention is made of stainless in order to prevent corrosion while conforming the fuel to the characteristics of the events/functions in accordance with various functions.

INDUSTRIAL APPLICABILITY

The fuel composition for colored flames of the present invention is improvement of realizing inflammability, ignitability and colored flames, which minimizes smoke and black dirt at combustion, and the combustion device of the present invention can control the complete combustion of the liquid fuel, the size of flames, and the change of color according to the pre-determined information/data. Thus, the effect provided by the present invention is remarkable in the industrial field to which the present invention pertains.

Specifically, the liquid fuel composition for colored flames and combustion device of the present invention control fuel supply from the fuel reservoir container/vessel which can change the colored flames such that they render mysteries of the functions/events so as to raise the level of the functions/events while attracting the interest of the participants for mood lifting or for celebration at Olympic games, athletic meetings, festivals, memorial ceremonies, an eve celebration, outdoor parties, etc.

We claim:

1. A fuel composition for colored flames comprising 0.1~6% by weight of a coloring agent, 75~90% by weight of fuel or fuel mixture comprising alcohol and/or amine, 2~20% of additive comprising ester bond and 2~10% by weight of a fire power enhancer having at least 3 carbons.

2. A fuel composition for colored flames according to claim 1, wherein the fuel is selected from methanol, ethanol or propanol.

3. A fuel composition for colored flames according to claim 1, wherein the fuel mixture comprises 45~55% by weight of methanol and 25 to 40% by weight of ethanol.

4. A fuel composition for colored flames according to claim 3, wherein the fuel mixture further comprises 2 to 10% by weight of propanol.

5. A fuel composition for colored flames according to claim 1, wherein the fuel mixture comprises 0.1~30% by weight of the amine, and 70~99.9% by weight of the alcohol.

6. A fuel composition for colored flames according to claim 1, wherein the fire power enhancer comprises butanol hexane, hexanol or acetone.

* * * * *